US006113428A

United States Patent [19]

Yeh

[11] Patent Number: 6,113,428

[45] Date of Patent: Sep. 5, 2000

[54] SHIELDED ELECTRICAL CONNECTOR

[75] Inventor: Joel Yeh-Haur Yeh, San Gabrie, Calif.

[73] Assignee: Hon Hai Precision Ind. Co., Ltd., Taipei Hsien, Taiwan

[21] Appl. No.: 09/365,469

[22] Filed: Aug. 2, 1999

[51] Int. Cl.[7] ..... H01R 13/648

[52] U.S. Cl. ..... 439/609; 439/939

[58] Field of Search ..... 439/541.5, 607, 439/608, 609, 79, 939

[56] References Cited

U.S. PATENT DOCUMENTS

| | | | |
|---|---|---|---|
| 5,637,015 | 6/1997 | Tan et al. | 439/607 |
| 5,702,271 | 12/1997 | Steinman | 439/607 |
| 5,738,544 | 4/1998 | Davis | 439/607 |
| 5,755,595 | 5/1998 | Davis et al. | 439/609 |
| 5,797,770 | 8/1998 | Davis et al. | 439/609 |

*Primary Examiner*—Gary F. Paumen
*Attorney, Agent, or Firm*—Wei Te Chung

[57] ABSTRACT

A shielded connector comprises an insulative front housing comprising a vertical wall from a front face of which a first front partition and a second front partition extend and the first front partition is located higher than the second front partition, and from a rear face of which a rear partition extends. A first right angle contact has a horizontal section attached to one face of the first front partition and a vertical section. A second right angle contact has a horizontal section attached to one face of the second front partition and a vertical section retained in the rear partition of the front housing. A rear housing receiving the vertical section of the first right angle contact is engaged with the front housing. The vertical section of the first right angle contact has most lengthwise portion thereof fixed to a vertical wall of the rear housing. An outer metal shell encircles the front housing and the rear housing.

18 Claims, 9 Drawing Sheets

SHIELDED ELECTRICAL CONNECTOR

BACKGROUND OF THE INVENTION

1. Field of The Invention

The present invention relates to a shielded electrical connector, particularly to a shielded electrical connector having two-piece housings for promoting positioning effect of right angle contacts received therein.

2. The Prior Art

Multi-port connectors are popular for achieving compact size compared to simple stacks of several single-port connectors. U.S. Pat. No. 5,797,770 discloses a two-port shielded connector having two plug receiving cavities defined by an inner shielding shell fixed on a protruded portion of an insulative housing and an outer shielding shell encircling the insulative housing. Right angle contacts are received and extend in the insulative housing from a rear face to a front face thereof. Each right angle contact has a horizontal section received in the housing between the front face and the rear face thereof and a vertical section retained in a rear portion of the housing and substantially parallel to the rear face thereof. The right angle contacts include longer ones and shorter ones, the longer ones being received in an upper port and the shorter ones being received in a lower port. For each shorter contact, the vertical section thereof may be received in a cavity formed in the rear portion of the housing. However, for each longer contact, the vertical section thereof can be only partially retained in a cavity formed in the rear portion of the housing and a considerable portion of which is exposed air without any support. These exposed portions of the vertical sections may cause short circuit if solder sputter during a wave soldering procedure. Moreover, long portion of the vertical section without support may have difficulty to register with opening formed in a printed circuit board on which the shielded connected is mounted. Especially when the connector is made to have more than two ports, the vertical section of the longest contact may have relatively long portion without support and cause more difficulty to register with the opening of the printed circuit board.

SUMMARY OF THE INVENTION

The primary objective of the present invention is to provide a multi-port shielded connector having a front housing and a rear housing cooperating to receive different right angle contacts having different lengths so that the vertical section of the longest contact can be supported by the rear housing.

In accordance with one aspect of the present invention, a shielded connector comprises an insulative front housing comprising a vertical wall from a front face of which a first front partition and a second front partition extend and the first front partition is located higher than the second front partition, and from a rear face of which a rear partition extends. A first right angle contact has a horizontal section attached to one face of the first front partition and a vertical section. A second right angle contact has a horizontal section attached to one face of the second front partition and a vertical section retained in the rear partition of the front housing. A rear housing receiving the vertical section of the first right angle contact is engaged with the front housing. The vertical section of the first right angle contact has most lengthwise portion thereof fixed to a vertical wall of the rear housing. An isolator extends forward from the vertical wall of the front housing and is spaced between the first front partition and the second front partition. An inner metal shell is connected to the isolator and spaced away from the first front partition and the second front partition. An outer metal shell encircles the front housing and the rear housing.

DETAILED DESCRIPTION OF THE PREFERRED EMBODIMENT

Figure 9:
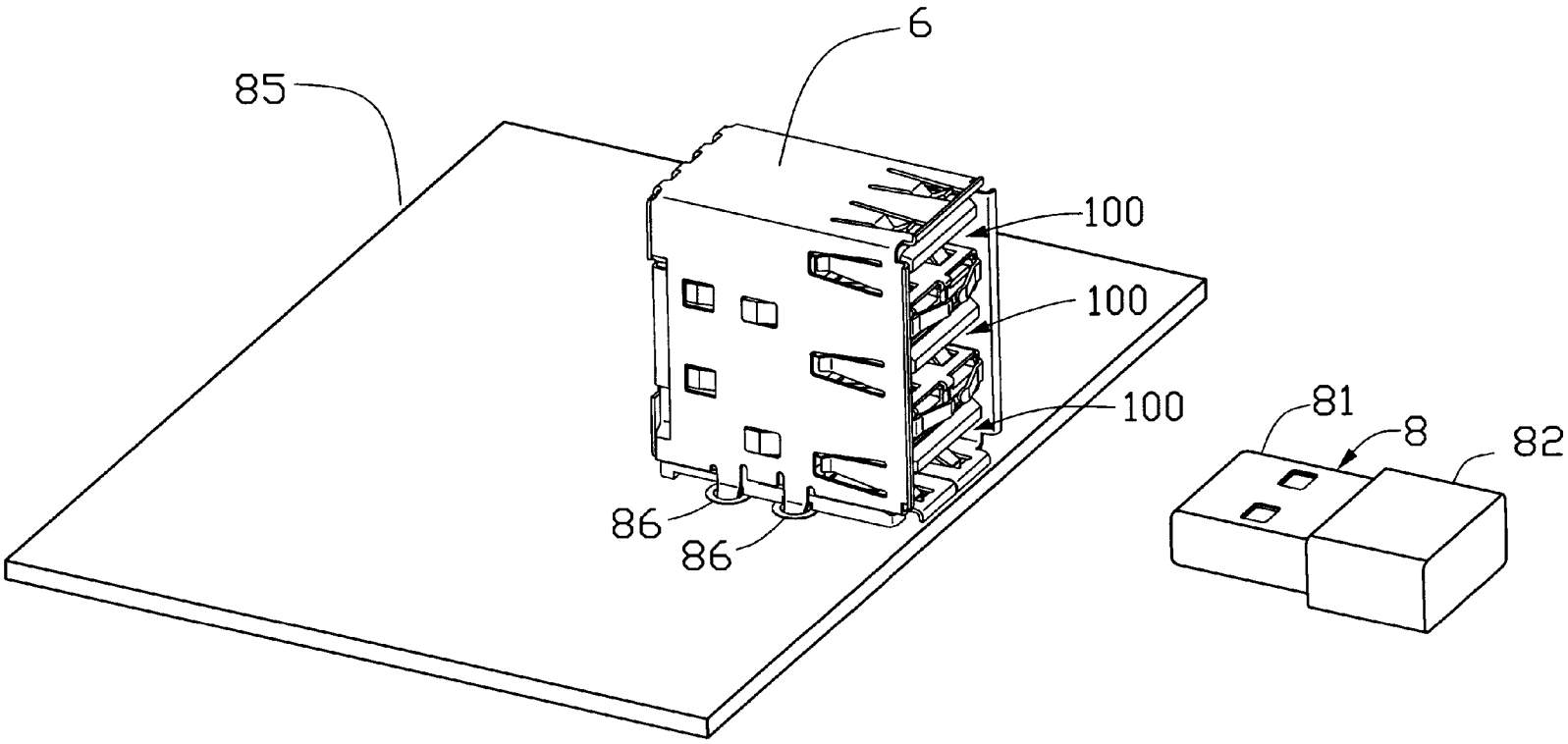
FIG. 9 is an assembled view of the shielded connector of the present invention to a printed circuit board, with an external plug connector adapted to be received in the shielded connector.

Referring to FIGS. 1A, 1B, 5 and 9, a shielded connector in accordance with the present invention comprises an insulative front housing 1, an insulative rear housing 2 attachable to the front housing 1, two inner metal shells 7 adapted to engage with the front housing 1, and an outer metal shell 6 adapted to encircle the front housing 1 and the rear housing 2. The front housing 1 and the rear housing cooperate to receive a first set of right angle contacts 31, a second set of right angle contacts 32, and a third set of right angle contacts 33. Each contact 31, 32, 33 has a horizontal section 311, 321, 331 for contacting with a corresponding pin of a complementary plug connector not shown and a vertical section 312, 322, 332 for connection to a printed circuit board 85 (FIG. 9).

Particularly referring to FIGS. 1A, 1B, 3, 4, and 5, the front housing 1 comprises a vertical wall 1A from opposite faces of which three front partitions 11 and two rear partitions 16 extend, respectively and substantially parallel to each other. The rear partitions 16 each have a plurality of spaced digits 16A for retaining the vertical sections 322, 332 of the second and third contacts 32, 33, respectively. Two isolators 12 extending forward from the vertical wall 1A are staggered between the three front partitions 11. Each front partition 11 has four passageways 110 extend horizontally side by side along an underside thereof for receiving the horizontal sections 311, 321, 331 of the contacts 31, 32, 33. Tapered protrusions 14 are formed in opposite sides of the vertical wall 1A. Bottom stands 15 extend forward from the vertical wall 1A for supporting the front housing 1. Each isolator 12 has a plurality of flanges 121 projected from opposite faces thereof. Two receptacles 10 are formed in each side face of the vertical wall 1A. A cap 13 extends rearward from a top face of the vertical wall 1A.

The rear housing 2 has a vertical wall 2A and a pair of positioning plates 20 extending upward from two sides of the vertical wall 2A for retaining the cap 13 of the front housing 1 when the rear housing 2 is assembled with the front housing 1. Four resilient arms 21 extend forward from two sides of the vertical wall 2A of the rear housing 2 and are adapted to be received in the receptacles 10 of the front housing 1. A plurality of positioning digits 22 extend forward from a bottom edge of the vertical wall 2A for retaining the vertical sections 322 of the second set of contacts 32 when the two housings 1, 2 are assembled. A row of holes 23 are formed in the vertical wall 2A for receiving the digits 16A of the upper rear partition 16 of the front housing 1 when the two housings 1, 2 are combined. A plurality of ribs 25 are projected from a top face of the vertical wall 2A for fixing rear portions of the horizontal sections 311 of the first contacts 31.

Each inner shell 7 has a clamping shape for connecting to a corresponding isolator 12. The inner shell 7 has a closure shape having a front opening 7A and a rear opening 7B. Two resilient tangs 71 extend laterally from opposite side faces thereof to the front opening 7A for contacting to a rear panel of a personal computer (not shown). A side tang 72 formed by stamping and bending extends outward from a side face of the inner shell 7 for contacting with the outer shell 6 when the latter is assembled with the front housing 1. Two resilient tabs 73 are formed in upper and bottom faces of the inner shell 7 for contacting with a complementary plug connector 8 (see FIG. 9). The resilient tabs 73 are staggered with the flanges 121 of the isolator 12 after the inner shell 7 fixes to the isolator 12.

Referring to FIGS. 3, 6, 7, 8 and 9, the outer shell 6 has a bottom opening 66 formed at a bottom wall thereof and a front open end and a rear open end (not labeled). A tail plate 61 horizontally extends from an upper edge of the rear open end comprising side portions 611 and an end portion 612 extending perpendicularly downward from edges of the tail plate 61. A plurality of apertures 610 are formed along a joint line between the tail plate 61 and the upper edge of the rear open end of the outer shell 6. Two engagement tabs 613 are formed in each side portion 611 by stamping. Two first holes 60 are formed in each side face of the outer shell 6 for engaging with the tapered protrusions 14 of the front housing 1 when the outer shell 6 is assembled to the front housing 1. Two second holes 62 are formed in each side face of the outer shell 6 nearer to the rear open end compared to the first holes 60. The engagement tabs 613 are received in the second holes 62 of the side faces after the tail plate 61 is bent from the row of apertures 610. Two snaps 67 are formed at opposite edges of the rear open end of the outer shell 6 for engagement with the side portions 611 of the tail plate 61. Curved plates 68 extend from front end of the outer shell 6 for contacting with a rear metal panel of a personal computer not shown. A plurality of resilient tabs 64 are formed in four faces of the outer shell 6. Particularly, each side face of the outer shell 6 has three resilient tabs 64 vertically aligned and each pair of opposite tabs 64 in the side faces is substantially in alignment with a corresponding front partition 11 when the outer shell 6 encircles the front housing 1 and the rear housing 2. Two terminals 63 extend downward from bottom edge of each side face for connection to openings 86 through a printed circuit board 85 (FIG. 9). A bottom edge 66A adjacent the bottom opening 66 is used to abut against a lower front face of the vertical wall 1A of the front housing 1 when the outer shell 6 encircle the housings 1, 2.

Figure 1A:
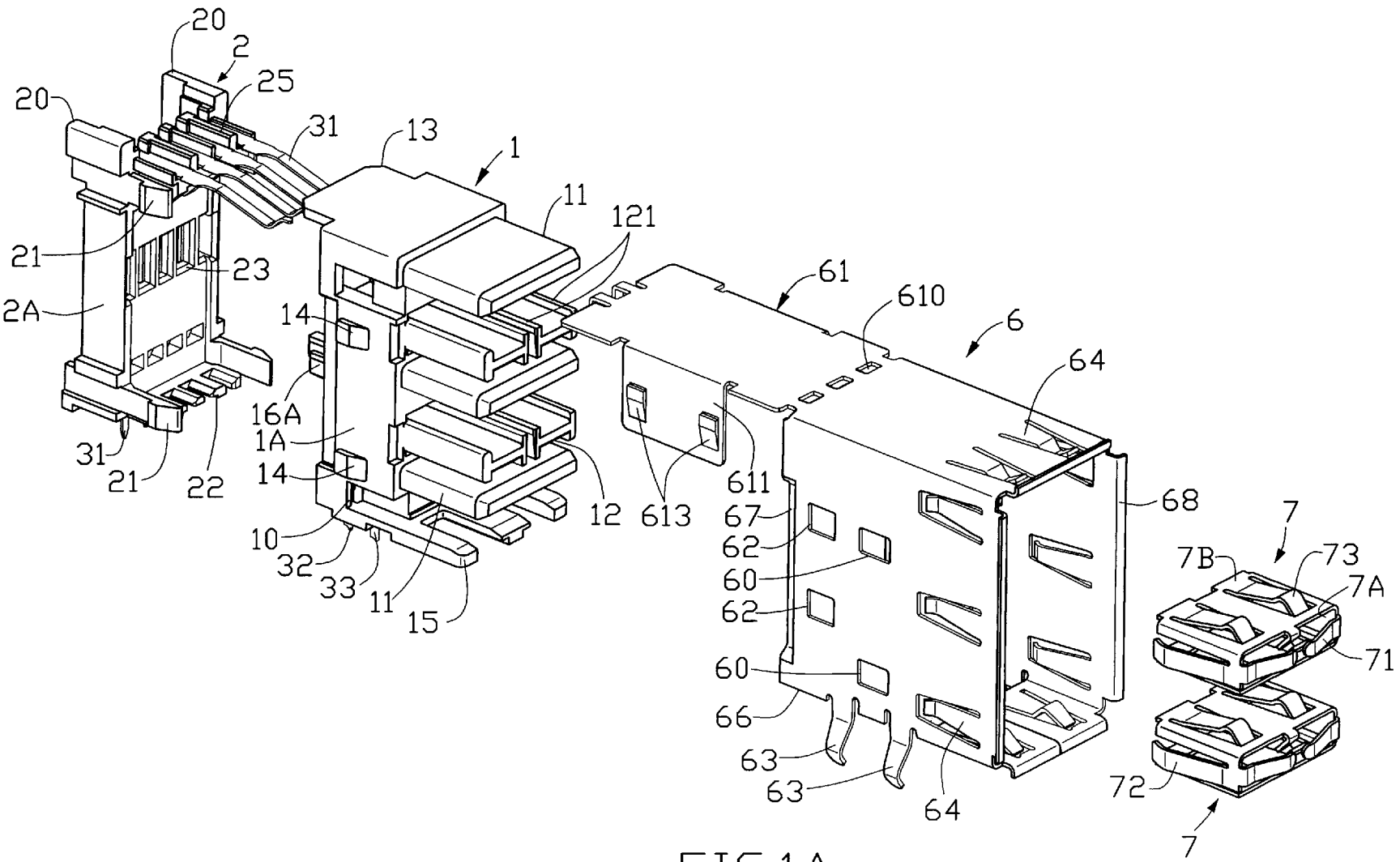
FIG. 1A is an exploded view of a shielded connector in accordance with the present invention.
Figure 1B:
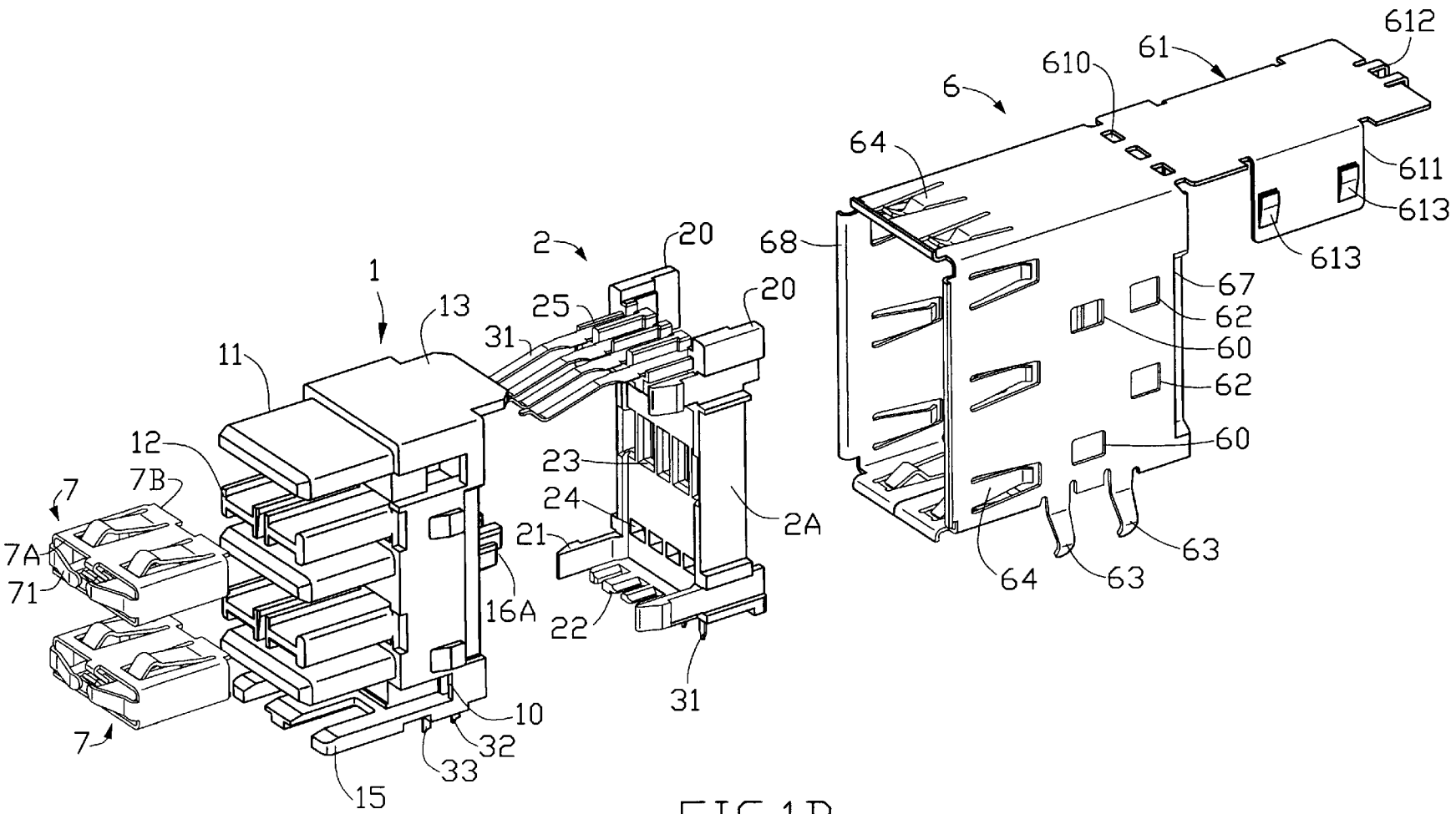
FIG. 1B is an exploded view of a shielded connector of FIG. 1 taken from a different angle.
Figure 2:
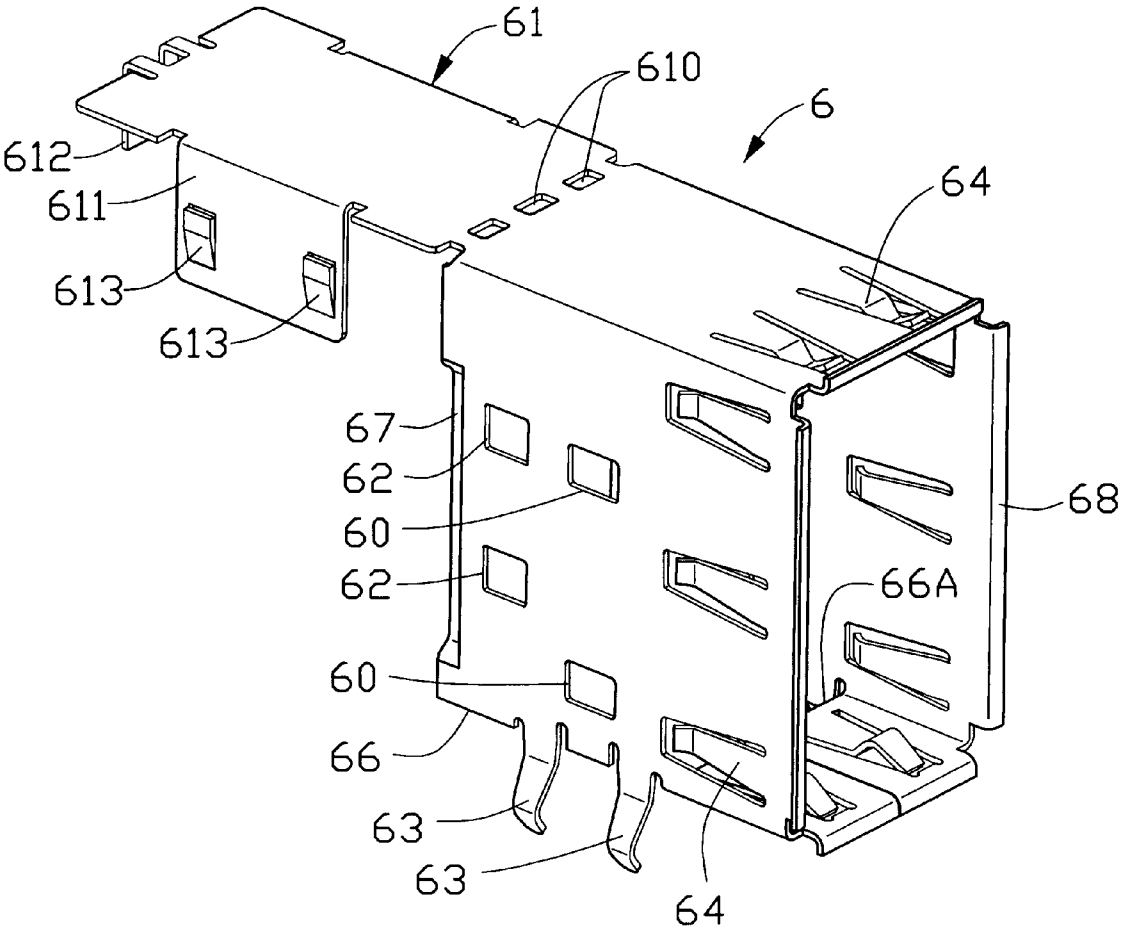
FIG. 2 is an enlarged view of an outer shell of FIG. 1A.
Figure 3:
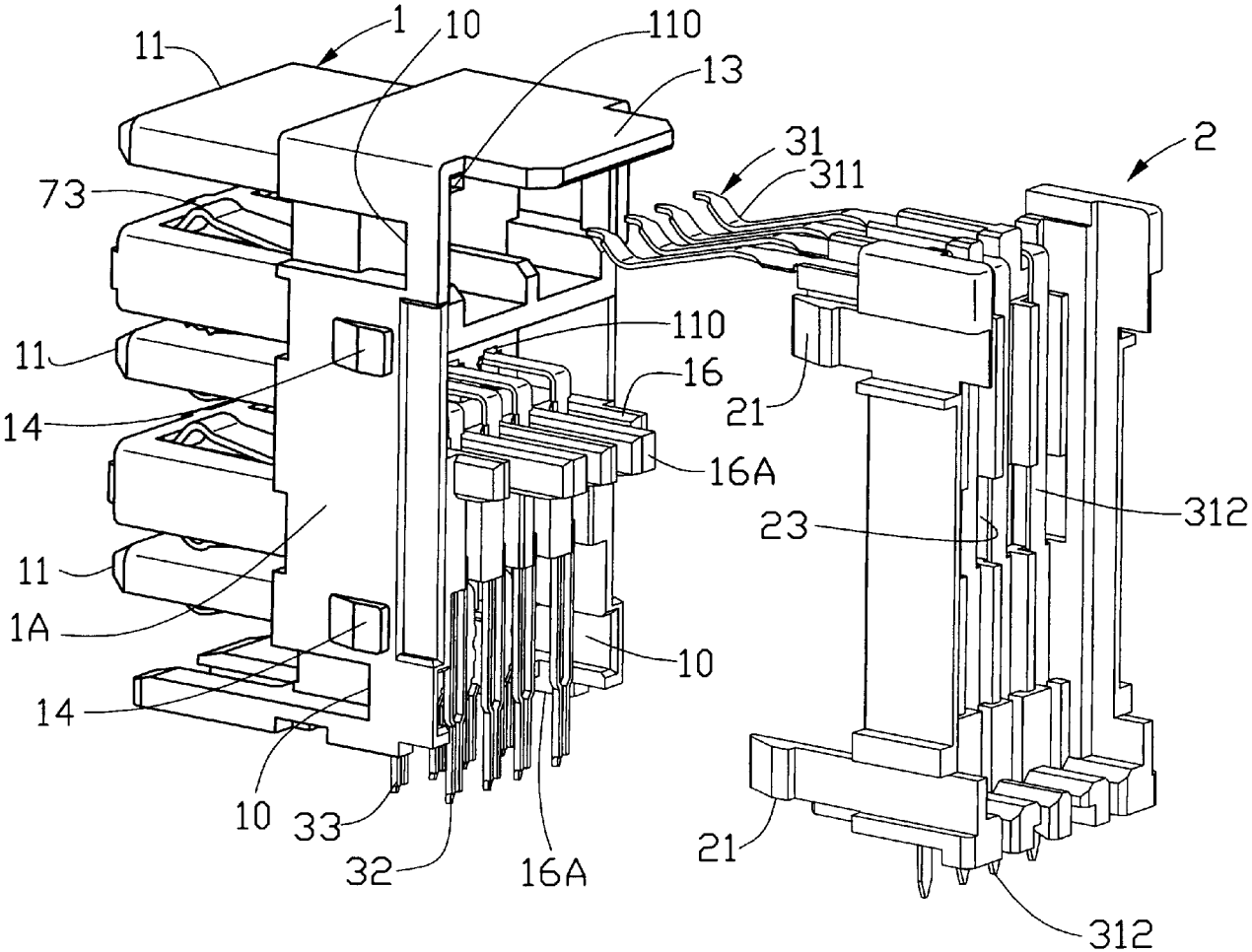
FIG. 3 is an enlarged view of two housings of FIG. 1 viewed from a different angle.
Figure 4:
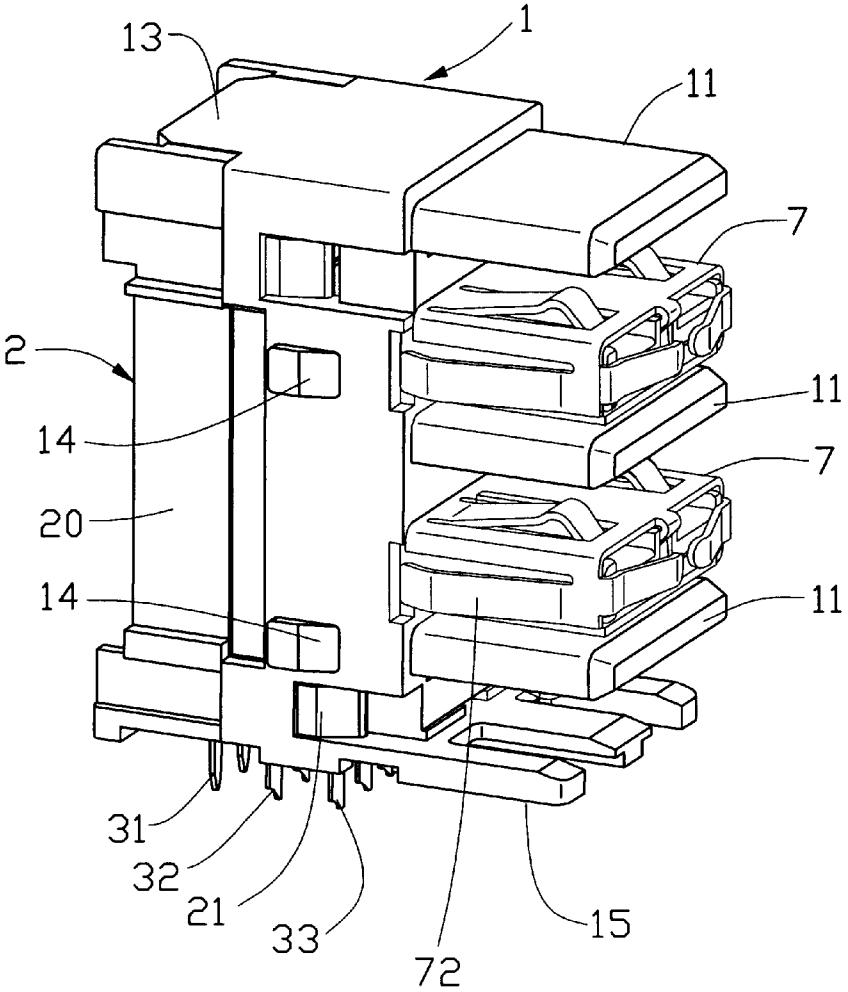
FIG. 4 is a semi-assembly view of FIG. 1, omitting an outer metal shell.
Figure 5:
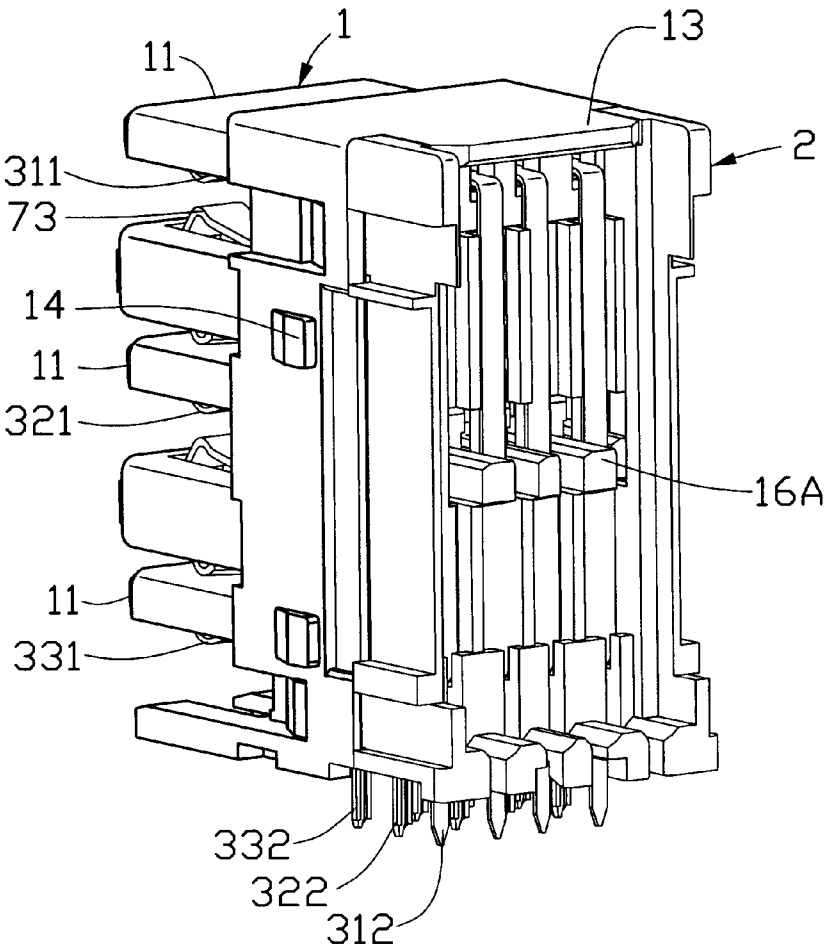
FIG. 5 is the semi-assembly of FIG. 4 viewed from a different angle.
Figure 6:
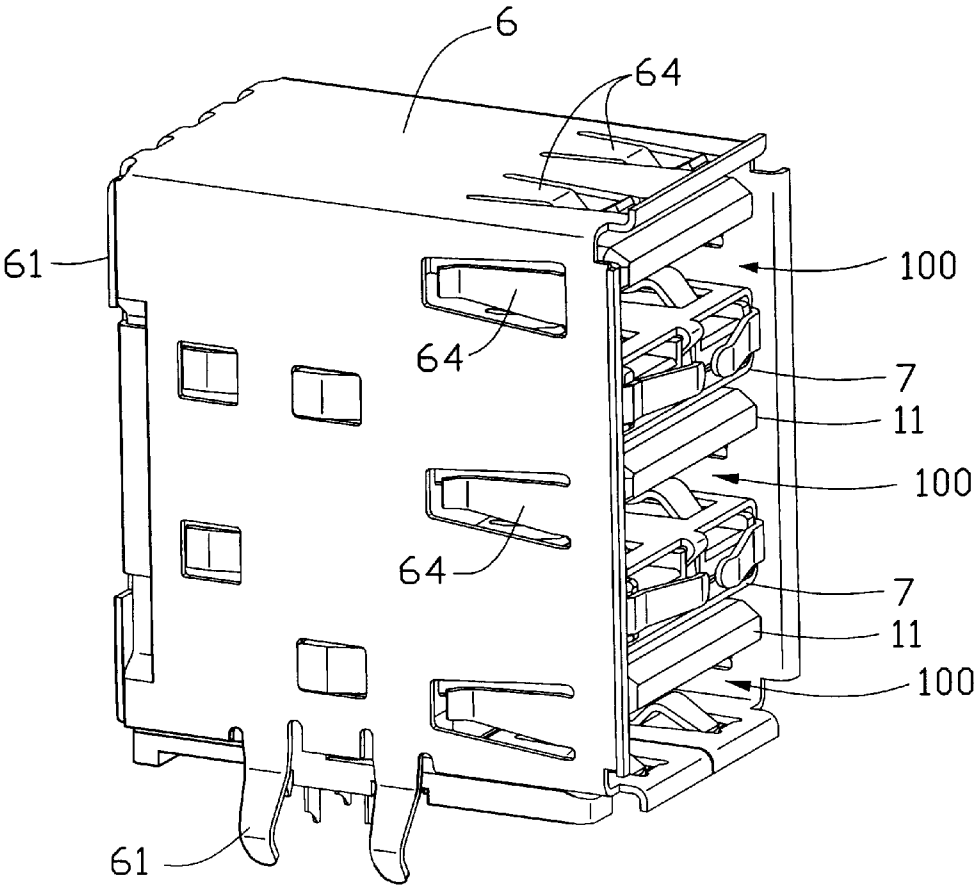
FIG. 6 is an assembled view of FIG. 1.
Figure 8:
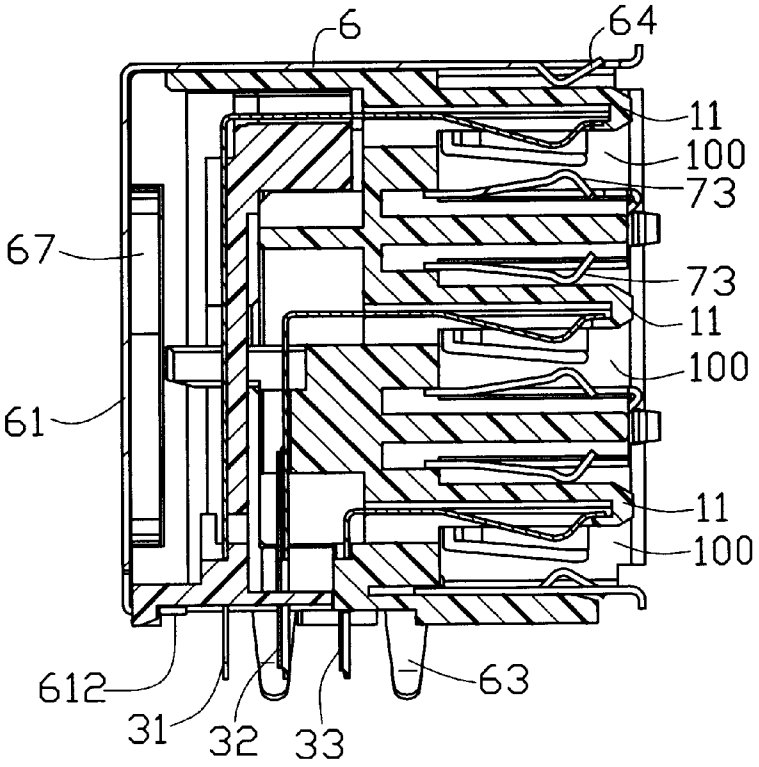
FIG. 8 is a cross-sectional view taken from line 8—8 of FIG. 7.
Figure 7:
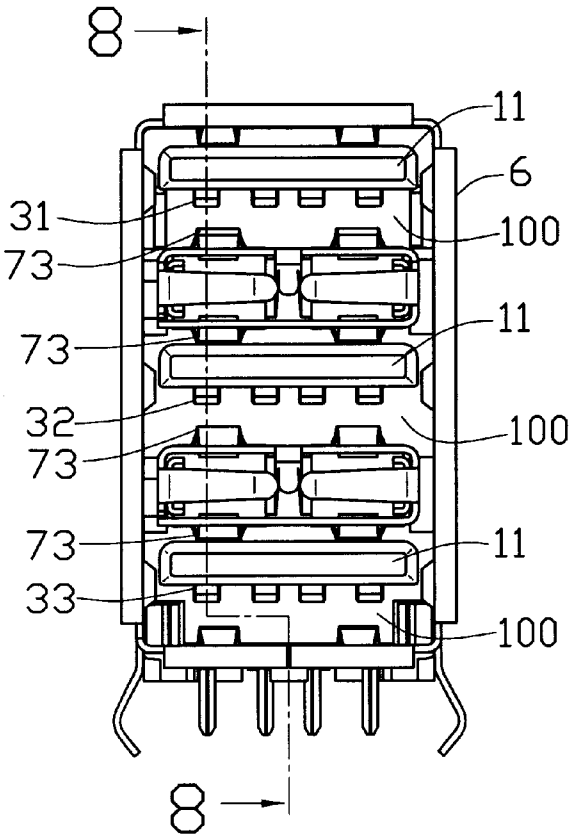
FIG. 7 is a front view of FIG. 6.

Particularly referring to FIGS. 6, 8 and 9, after the final configuration of the outer shell 6 and the housings 1, 2, three plug reception cavities 100 are defined around the front partitions 11 and surrounded by portions of the outer shell 6 and the inner shell 7. Each plug reception cavity 100 can receive a corresponding plug connector 8 which has an outer metal shielding 81 extending from an insulative housing 82. The plug connector 8 when inserted into the plug reception cavity 100 will electrically and mechanically contact with the resilient tabs 64 of the outer shell 6 and the resilient tabs 73 of the inner shell 7 thereby increasing the grounding area of the two connectors.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A shielded connector comprising:

an insulative front housing comprising a vertical wall from a front face of which a first front partition and a second front partition extend and the first front partition is located higher than the second front partition, and from a rear face of which a rear partition extends;

a first right angle contact having a horizontal section attaching to one face of the first front partition and a vertical section;

a second right angle contact having a horizontal section attaching to one face of the second front partition and a vertical section retained in the rear partition of the front housing;

a rear housing receiving the vertical section of the first right angle contact and engaged with the front housing, wherein most of the vertical section of the first right angle contact is fixed to a vertical wall of the rear housing;

an isolator extending forward from the vertical wall of the front housing and spaced between the first front partition and the second front partition;

an inner metal shell connected to the isolator and spaced away from the first front partition and the second front partition; and an outer metal shell encircling the front housing and the rear housing.

2. The shielded connector as claimed in claim 1, wherein the inner metal shell has a side tang extending outward from a side face thereof for contacting with the outer metal shell.

3. The shielded connector as claimed in claim 1, wherein the inner metal shell has a tab extending from a front face thereof for contacting with a metal panel of a personal computer.

4. The shielded connector as claimed in claim 1, wherein the isolator has flanges extending from opposite side faces thereof for contacting with the inner metal shell.

5. The shielded connector as claimed in claim 1, wherein the inner metal shell has resilient tabs formed at upper and lower surfaces thereof and staggered with regard to the flanges of the isolator when the inner metal shell is connected to the isolator.

6. The shielded connector as claimed in claim 1, wherein at least one resilient arm extends forward from each side of the rear housing for engagement within corresponding receptacles formed in the front housing.

7. The shielded connector as claimed in claim 1, wherein the rear housing has a vertical wall and a pair of positioning plates extending upward from two sides of the vertical wall for retaining a cap extending from the front housing when the rear housing is assembled with the front housing.

8. The shielded connector as claimed in claim 1 further comprising several stand-offs extending from a front face of the vertical wall of the front housing for supporting the front housing.

9. The shielded connector as claimed in claim 1, wherein the outer metal shell has a tail plate horizontally extending from an upper edge of a rear open end thereof and bendable to cover the rear open end of the outer metal shell.

10. The shielded connector as claimed in claim 9, wherein a plurality of apertures are formed along a joint line between the tail plate and the upper edge of the rear open end of the outer shell.

11. The shielded connector as claimed in claim 7, wherein a plurality of positioning digits extend forward from a bottom edge of the vertical wall of the rear housing for retaining the vertical section of the second contact when the front housing and the rear housing are assembled.

12. The shielded connector as claimed in claim 10, wherein two snaps are formed at opposite edges of the rear open end of the outer shell for engagement with side portions of the tail plate when the tail plate is bent to cover the rear open end of the outer metal shell.

13. A shielded connector comprising:

an insulative front housing comprising a vertical wall from a front face of which an upper front partition, a middle front partition, and a lower front partition extend, and from a rear face of which a middle rear partition and a lower rear partition extend;

an insulative rear housing comprising a vertical wall from a top face of which an upper partition extends and from a rear face of which a rear partition extends and across along a vertical lengthwise region of the rear face, wherein the rear housing is attachable to the front housing;

a first right angle contact having a horizontal section having a rear portion thereof retained in the upper partition of the rear housing and a front portion thereof extending forward and a vertical section retained in the rear partition of the rear housing, wherein the front portion of the horizontal section of the first right angle contact is retained in the upper front partition of the front housing when the rear housing is attached to the front housing;

a second right angle contact having a horizontal section retained in the middle front partition of the front housing and a vertical section retained in the middle rear partition of the front housing;

a third right angle contact having a horizontal section retained in the lower front partition of the front housing and a vertical section retained in the lower rear partition of the front housing; and an outer metal shell encircling the front housing and the rear housing;

further comprising two isolators extending forward from the vertical wall of the front housing and substantially staggered between the upper front partition, the middle front partition, and the lower front partition;

further comprising two inner metal shells respectively connected to the isolators and spaced away from adjacent front partitions.

14. A shielded connector comprising:

an insulative front housing comprising a vertical wall from which an upper first front partition and a lower second front partition extend forward, a lower rear partition extends rearward opposite to said lower front partition, and an isolator extending forwardly from the vertical wall and between said upper first front partition and said lower second front partition;

a first set of contacts and a second set of contacts respectively extending along the upper first front partition and the lower second front partition in the front housing;

an insulative rear housing secured to the front housing, said rear housing including means for retaining the first set of contacts in position and said front housing including means for retaining the second set of contacts in position;

an outer metal shell encircling the front housing and the rear housing, said outer shell defining a front opening for receiving mated plugs therein; and an inner metal shell attached to the isolator from said front opening.

15. The shielded connector as claimed in claim 14, wherein said rear housing further includes means for retaining the second set of contacts.

16. The shield connector as claimed in claim 14, wherein the front housing further defines, below the lower second front partition, a third front partition with a third set of contacts thereon, and another isolator is positioned between the lower second front partition and the third front partition.

17. The shielded connector as claimed in claim 14, wherein said inner shell defines at least a front tang for contacting a panel of a computer case in which the shielded connector is positioned, at least a side tang for contacting the outer shell, and at least a tab for engagement with a mating plug.

18. A shielded connector comprising:

an insulative front housing comprising a vertical wall from which an upper first front partition, a middle second front partition, and a lower third front partition respectively extend forward, a middle first rear partition and a lower second rear partition extend rearward respectively opposite to said middle second front partition and the lower third front partition;

an upper first isolator and a lower second isolator respectively extending forwardly from the vertical wall and between said upper first front partition and said middle second front partition, and between said middle second front partition and said lower third front partition;

a first set of contacts, a second set of contacts and a third set of contacts respectively extending along the upper first front partition, the middle second front partition, and the lower third front partition in the front housing;

an insulative rear housing secured to the front housing, said rear housing including means for retaining at least the first set of contacts in position;

an outer metal shell encircling the front housing and the rear housing, said outer metal shell defining a front opening for receiving mated plugs therein; and two inner shells respectively attached to the corresponding two isolators from said front opening wherein each of said inner metal shells includes at least on resilient tab facing to the corresponding one front partition.

* * * * *